US007175046B2

(12) United States Patent
Yao

(10) Patent No.: US 7,175,046 B2
(45) Date of Patent: Feb. 13, 2007

(54) MERCHANDISE OUTPUT DEVICE OF A VENDING MACHINE

(76) Inventor: Shen-Hao Yao, 235 Chung-Ho Box 8-24, Taipei (TW)

( * ) Notice: Subject to any disclaimer, the term of this patent is extended or adjusted under 35 U.S.C. 154(b) by 242 days.

(21) Appl. No.: 10/872,005

(22) Filed: Jun. 21, 2004

(65) Prior Publication Data

US 2005/0279760 A1 Dec. 22, 2005

(51) Int. Cl.
*B65F 11/16* (2006.01)
*B65H 3/60* (2006.01)

(52) U.S. Cl. ..... 221/265; 221/263; 221/264; 221/203; 221/35

(58) Field of Classification Search ..... 221/203, 221/264, 263, 265, 65, 35
See application file for complete search history.

(56) References Cited

U.S. PATENT DOCUMENTS

| | | | | |
|---|---|---|---|---|
| 1,490,365 | A * | 4/1924 | Du Grenier | 221/265 |
| 1,540,389 | A * | 6/1925 | Felton | 194/256 |
| 1,627,547 | A * | 5/1927 | Antoine et al. | 221/152 |
| 1,929,788 | A * | 10/1933 | Myers et al. | 221/264 |
| 2,537,317 | A * | 1/1951 | Probasco | 222/153.03 |
| 3,101,872 | A * | 8/1963 | Dickinson | 222/197 |
| 3,593,882 | A * | 7/1971 | Rhindress | 221/150 A |
| 3,810,535 | A * | 5/1974 | Phipps | 194/296 |
| 3,894,657 | A * | 7/1975 | Eckmayr | 221/265 |
| 5,082,101 | A * | 1/1992 | Baker et al. | 194/350 |
| 5,176,290 | A * | 1/1993 | Schwarzli | 221/203 |
| 5,280,845 | A * | 1/1994 | Leight | 221/2 |
| 5,673,812 | A * | 10/1997 | Nelson | 221/82 |
| 6,935,530 | B2 * | 8/2005 | Semeniuk et al. | 221/124 |

FOREIGN PATENT DOCUMENTS

| | | | |
|---|---|---|---|
| CA | 2206733 A | * | 12/1998 |
| JP | 9-16832 | * | 1/1997 |

* cited by examiner

*Primary Examiner*—Patrick Mackey
*Assistant Examiner*—Michael Butler

(57) ABSTRACT

A merchandise output device of a vending machine comprises a machine body; a groove body in the machine body; a rotary disk and a rotary disk and a guide plate installed above the rotary disk and being an approximate right-angled triangular plate. The guide plate is obliquely installed above the rotary disk corresponding to the upper side of the outlet at the bottom of the groove body. A first right angle side of the guide plate is obliquely installed to a first wall of the groove body. A first apex between the first right angle side and the hypotenuse is placed near an upper side of the rotary disk. The second right angle side is horizontally installed to a second wall of the groove body adjacent to the first wall. A second apex between the second right angle side and the hypotenuse is placed higher than the first apex.

1 Claim, 8 Drawing Sheets

MERCHANDISE OUTPUT DEVICE OF A VENDING MACHINE

FIELD OF THE INVENTION

The present invention relates to vending machine, and more particular to a merchandise output device of a vending machine, which can improve the prior art defects.

BACKGROUND OF THE INVENTION

Referring to FIGS. 1 to 4, a prior art vending machine is illustrated for sailing merchandises of small sizes and having irregular shapes. To output the merchandise successfully, in general, the merchandises in the vending machine have a ball-like shape.

With reference to FIG. 1, the prior art vending machine is illustrated. The vending machine has the following elements. A machine body 10 is included. A groove body 20 is in the machine body 10. A rotary disk 30 is installed in the groove body 20. A bottom of the groove body 20, see FIGS. 2 and 3, has an outlet 21 for outputting a merchandise 40. An inner diameter of the outlet 21 is slightly larger than an outer diameter of the merchandise 40. A lower side of the outlet 21 is connected to a transfer tube 11 to an opening 12 at a bottom of the machine body 10.

A rotary disk 30, referring to FIGS. 2, 3, has a plurality of receiving holes 31 for receiving the merchandises 41. An upper center of the rotary disk 30 has three helical rotatable rods 32. A bottom of the rotary disk 30 is installed with a plurality of rollers 33. The rotary disk 30 is rotatable in the groove body 20 by the driving of a motor 34.

By above said structure, in the prior art vending machine, by rotating the rotary disk 30, the merchandise 40 in the receiving hole 31 of the rotary disk 30 will be driven to the outlet 21 in the bottom of the groove body 20. The merchandise will drop down from the outlet 21 and then to the opening 12 at the bottom of the machine body 10 along the transfer tube 11, see FIG. 3 so as to output the merchandise 40.

However, above mentioned prior art has the following disadvantages.

Firstly, before sailing, the merchandises 40 are irregularly placed above the rotary disk 30. Thereby, it is possible that the merchandises 40 are arranged at two sides of the receiving holes 31 of the rotary disk 30, see FIG. 2 so that the merchandises 40 can not successfully drop down. As a result, the merchandises 40 cannot be sold successfully.

Since the un-sold merchandises are arranged irregularly on the machine body 10 above the rotary disk 30, it is possible that the merchandises are overlapped longitudinally upon the receiving hole 31 of the rotary disk 30, see FIG. 4. As a result, the merchandises will be sold repeatedly. Furthermore since the un-sold merchandises are arranged irregularly on the machine body 10 above rotary disk 30, it is often that the rotary disk will be over-compressed so as to deform.

SUMMARY OF THE INVENTION

Accordingly, the primary object of the present invention is to provide a merchandise output device of a vending machine, which can improve the prior art defects.

To achieve above objects, the present invention provides a merchandise output device of a vending machine. The device has a machine body; a groove body, a rotary disk and a guide plate.

The groove body is in the machine body; a rotary disk being installed in the groove body; a bottom of the groove body having an outlet for outputting a merchandise. A lower side of the outlet is connected to a transfer tube to an opening at a bottom of the machine body.

A rotary disk has a plurality of receiving holes for receiving the merchandises; the rotary disk being rotatable in the groove body by the driving of a motor.

A guide plate installed above the rotary disk, the guide plate is an approximate right-angled triangular plate. The guide plate being obliquely installed above the rotary disk corresponding to the upper side of the outlet at the bottom of the groove body. A first right angle side of the guide plate is obliquely installed to a first wall of the groove body. A first apex between the first right angle side and the hypotenuse is placed near an upper side of the rotary disk; the second right angle side being horizontally installed to a second wall of the groove body adjacent to the first wall of the groove body. A second apex between the second right angle side and the hypotenuse is placed higher than the first apex.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 5 to 8, the preferred embodiment of the present invention is illustrated.

Figure 1:
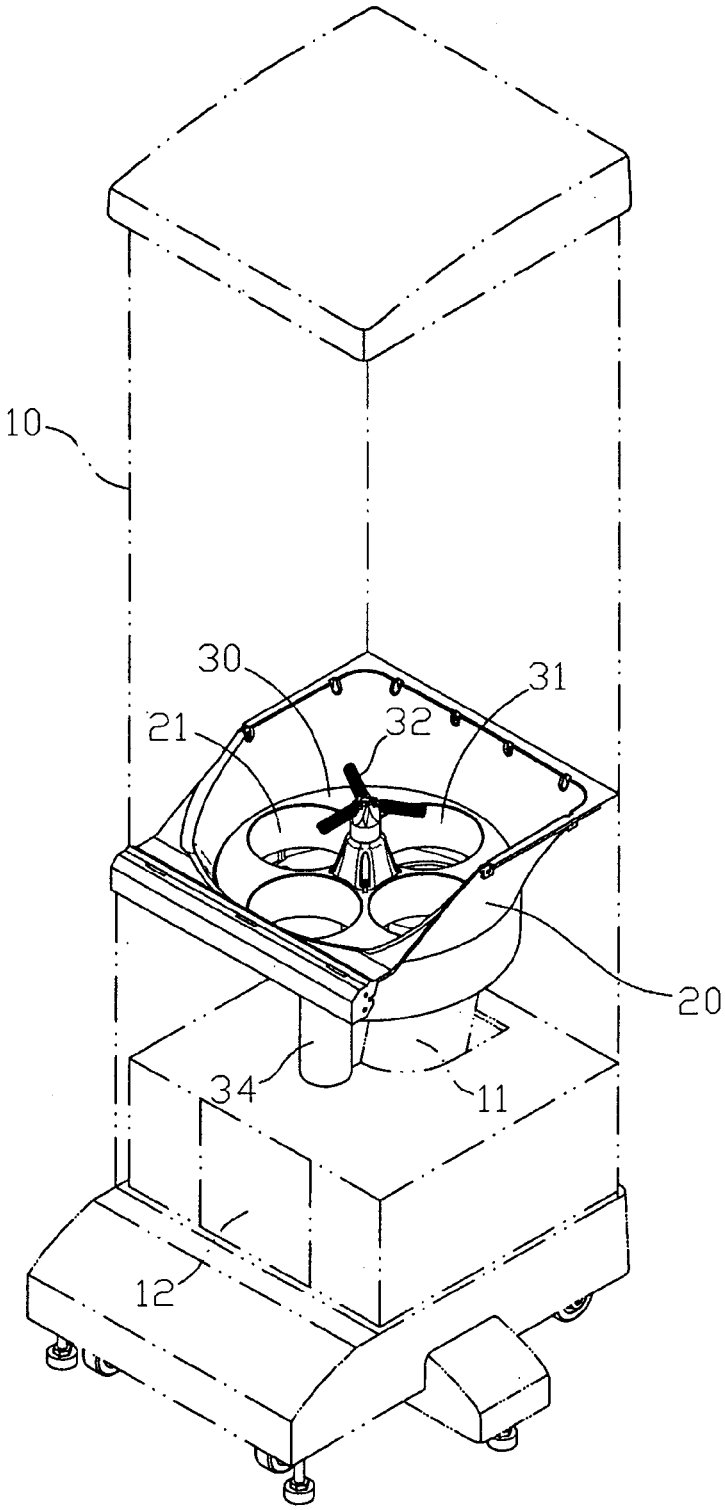
FIG. 1 is a perspective view of an output structure of a prior art vending machine.
Figure 2:
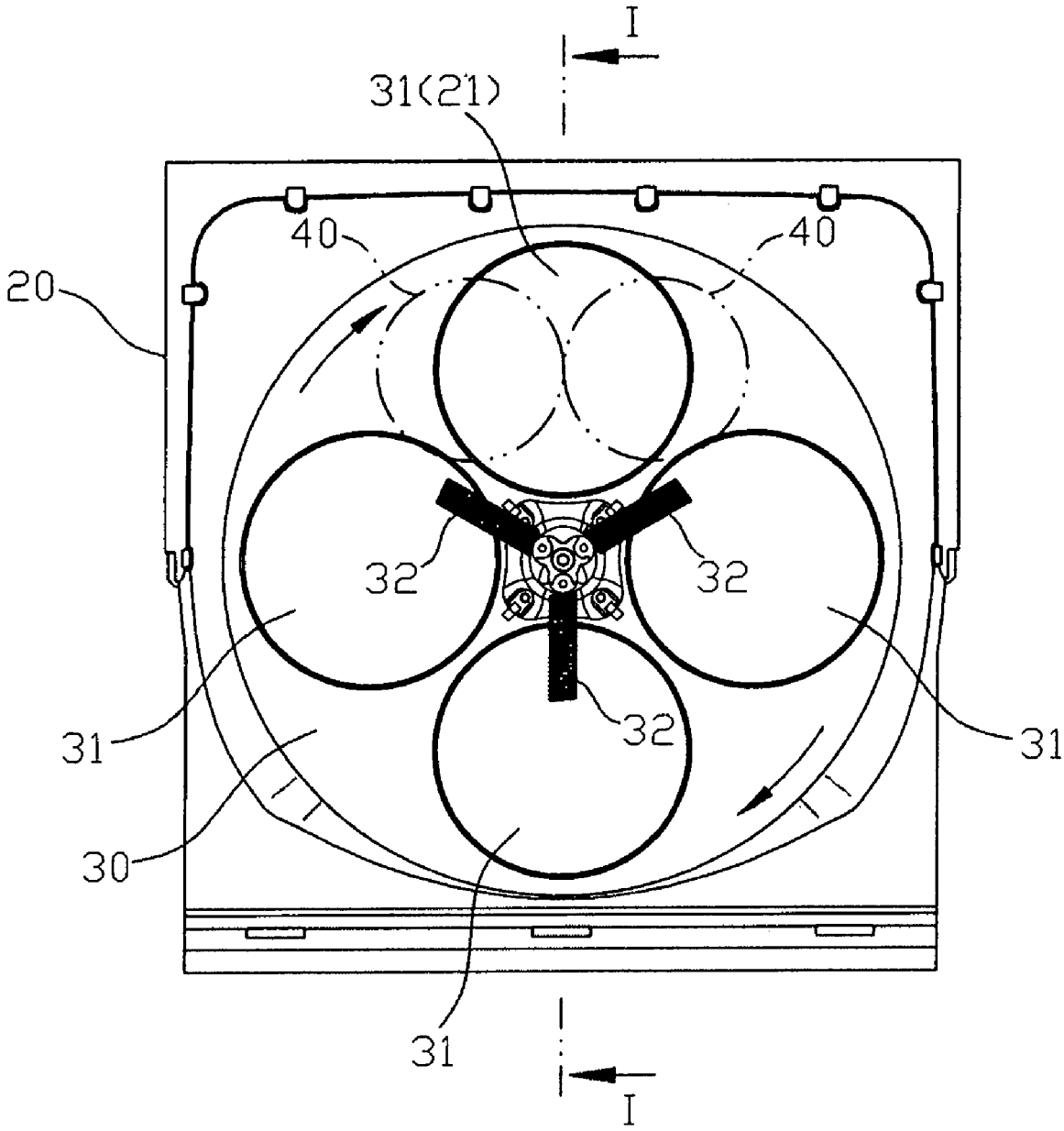
FIG. 2 is an upper view of the FIG. 1, wherein it is illustrated that the merchandises are arranged on a rotary disk.
Figure 3:
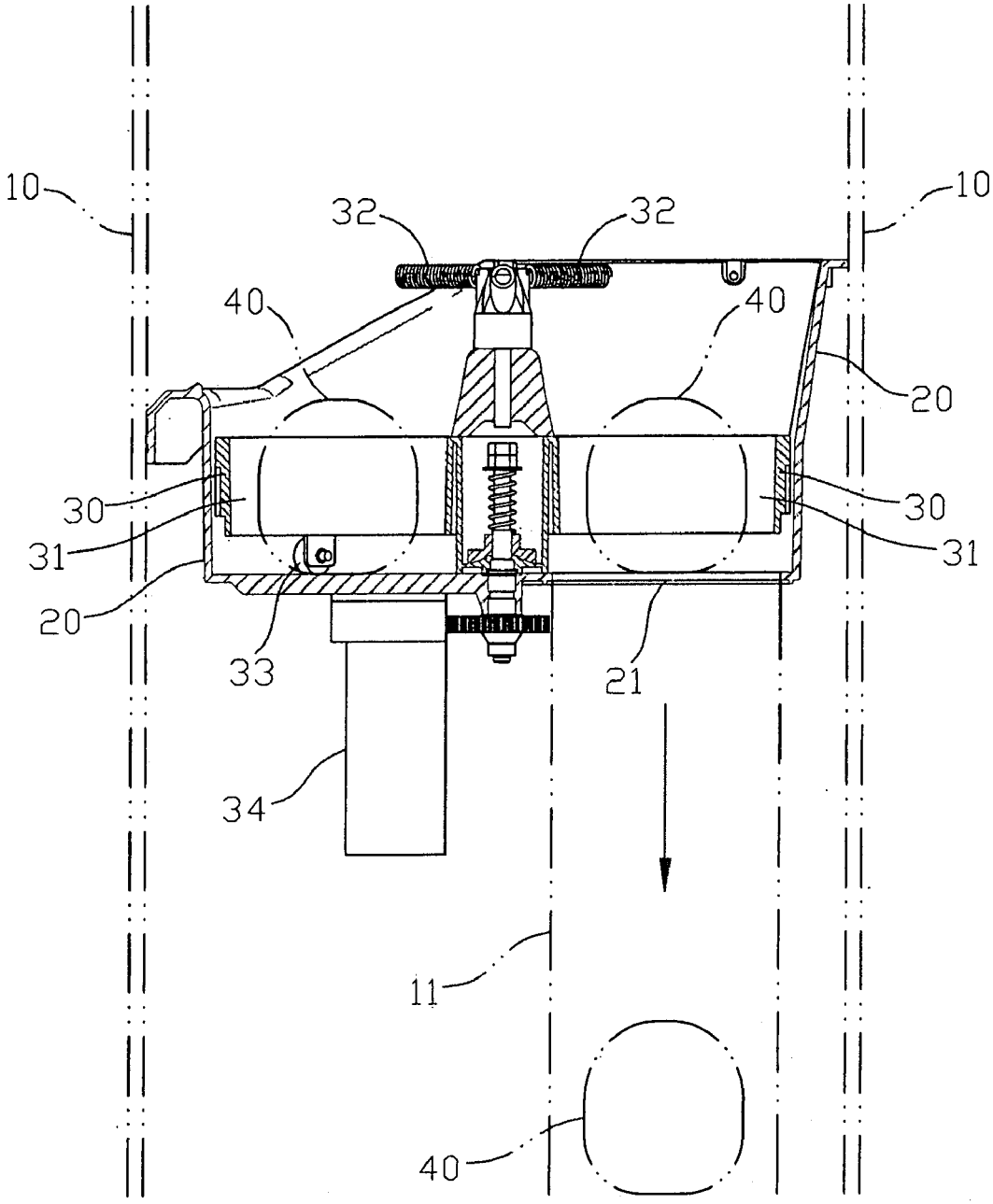
FIG. 3 is a cross section view along line I—I of FIG. 2, wherein the merchandise is outputted successfully.
Figure 4:
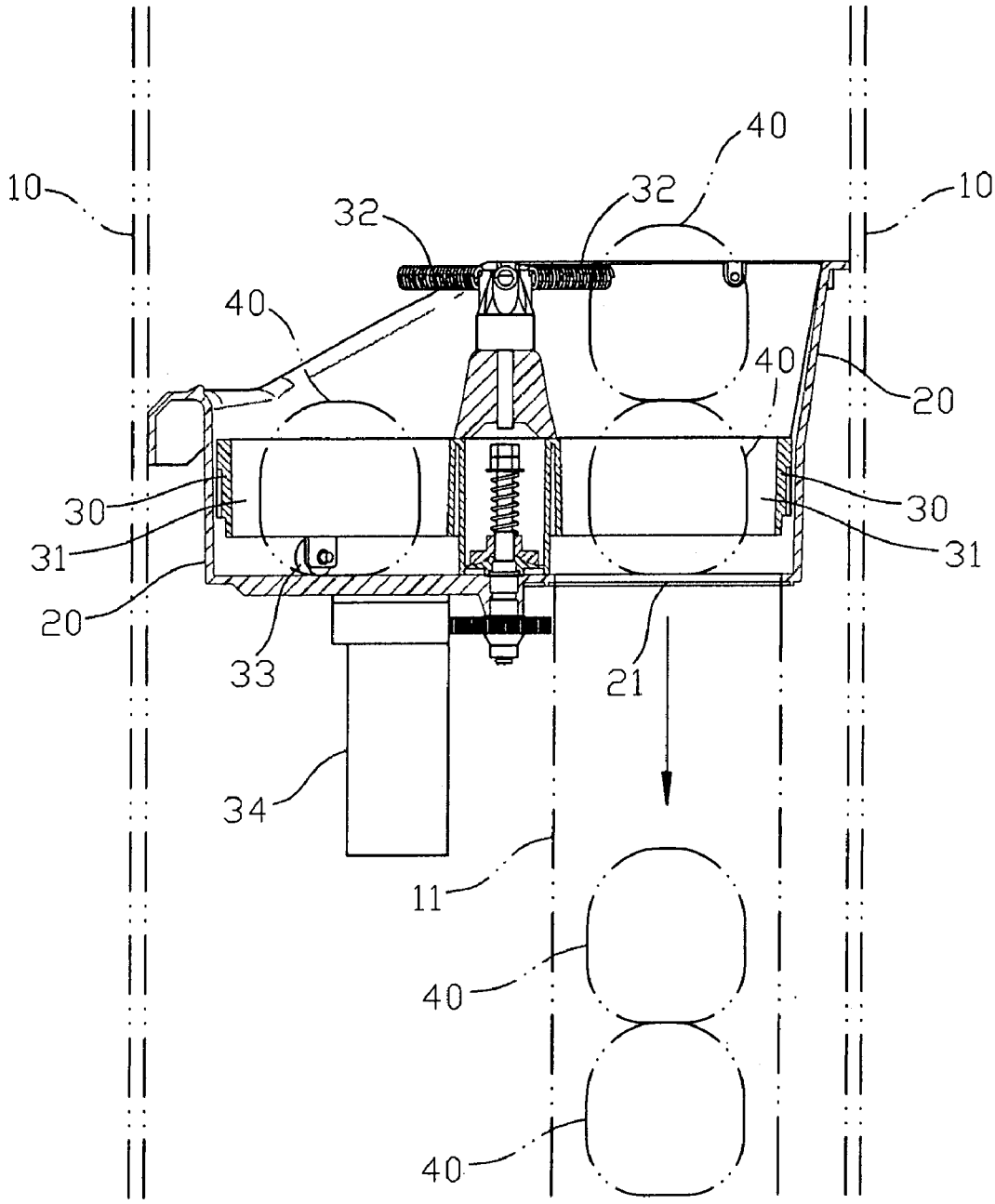
FIG. 4 is a cross section view along line I—I of FIG. 2, wherein merchandises are overlapped on the rotary disk.
Figure 5:
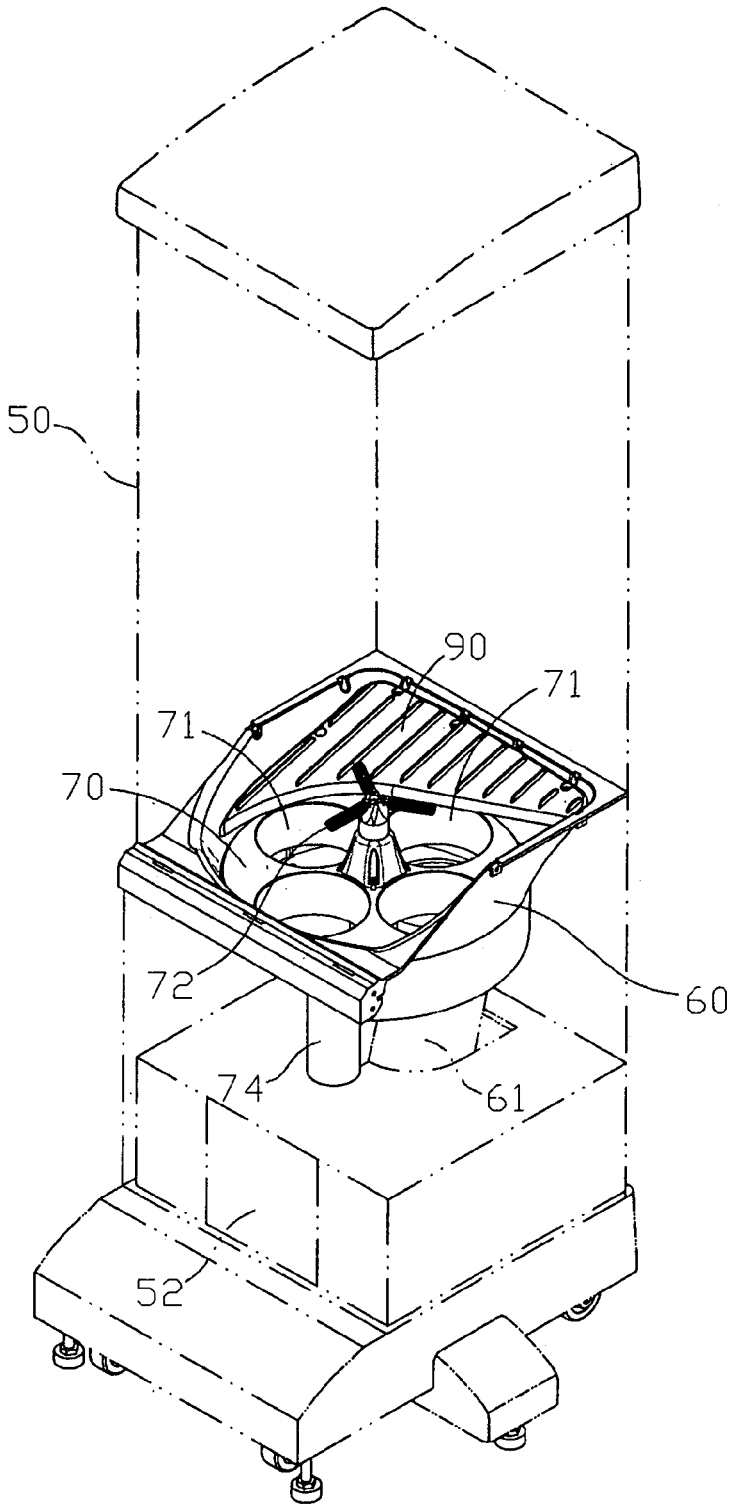
FIG. 5 is a perspective view of the present invention.

See FIG. 5, the present invention has the following elements.

A machine body 50 is included.

Figure 6:
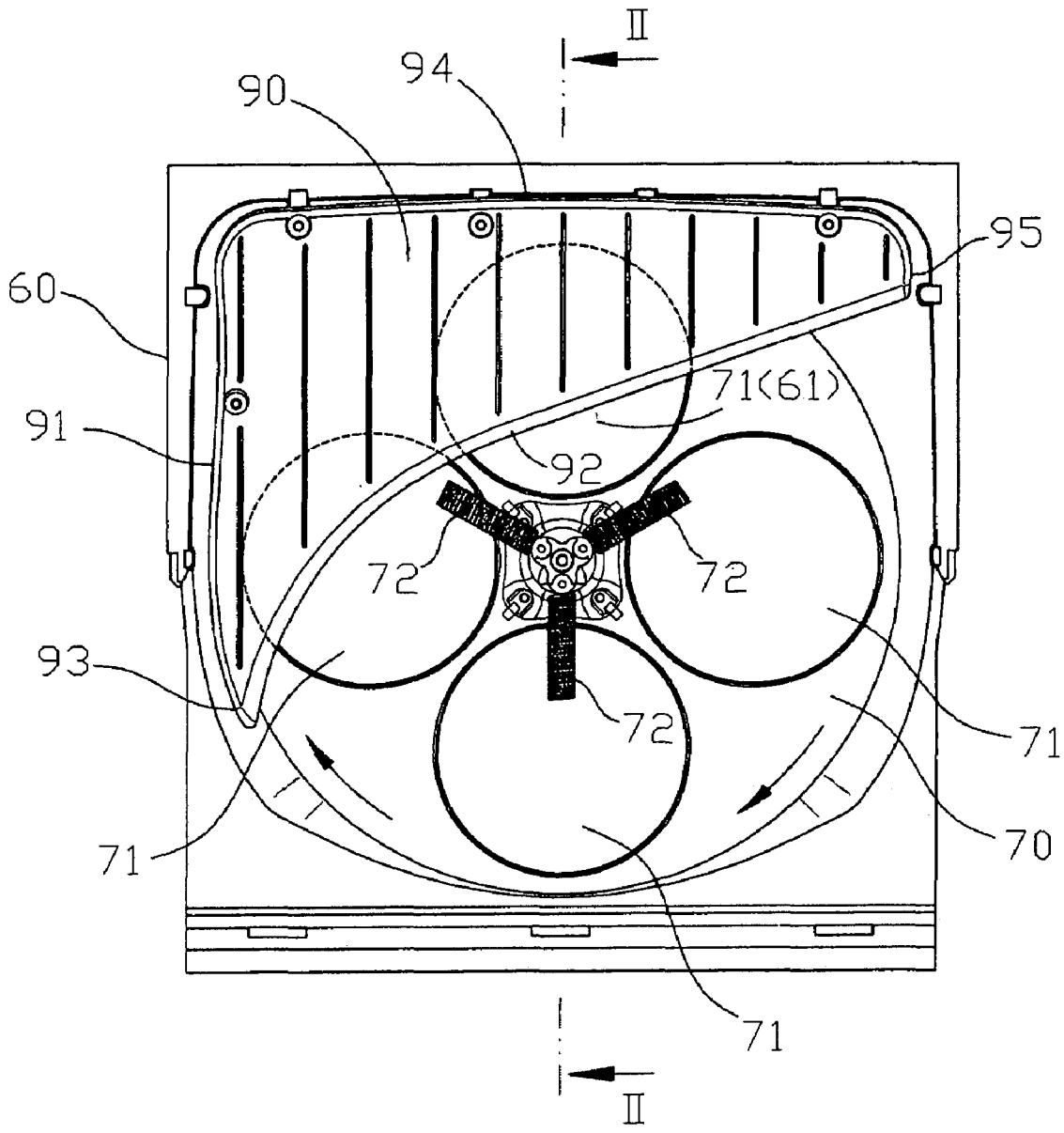
FIG. 6 is an upper view of the present invention.
Figure 7:
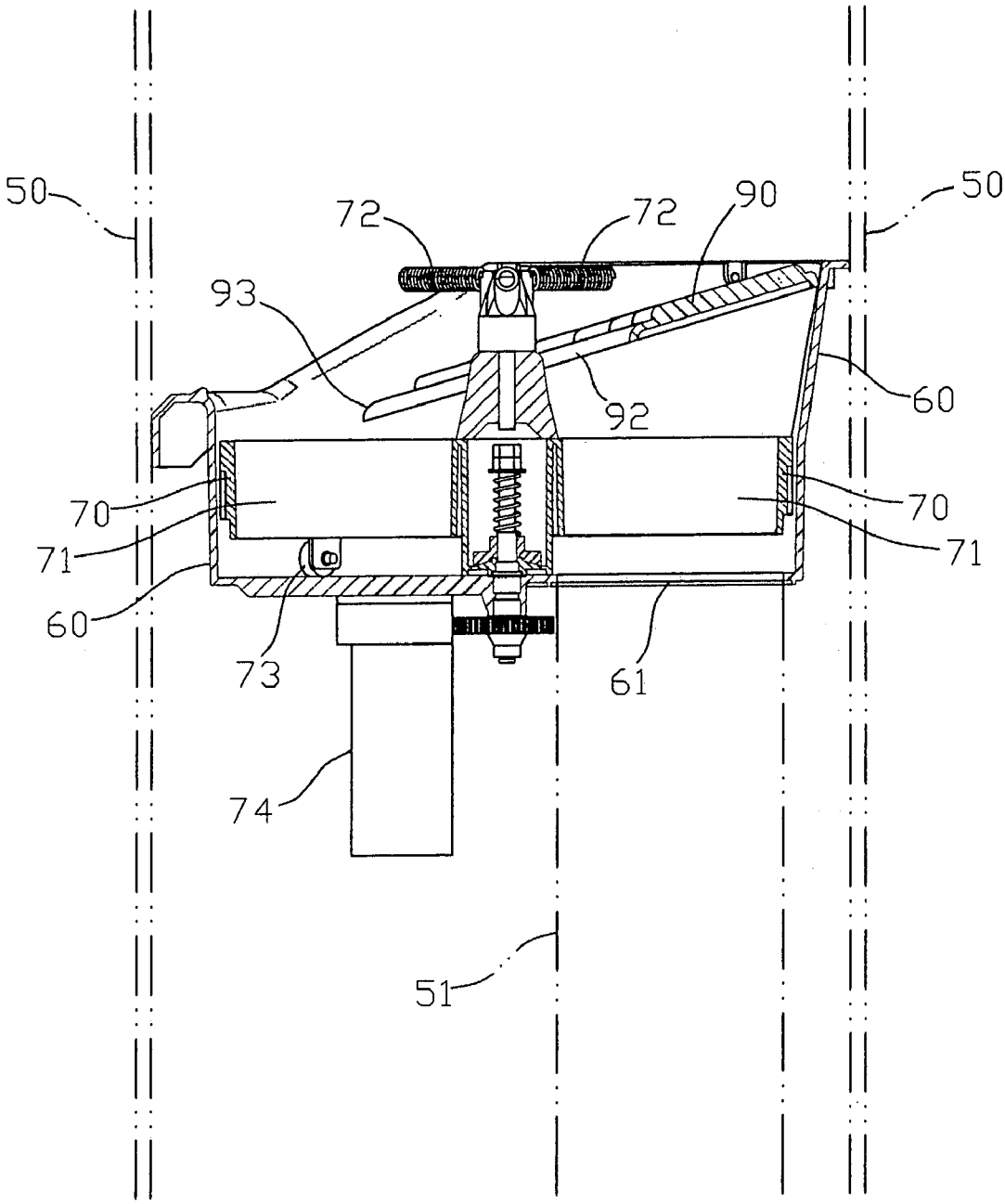
FIG. 7 is a cross section view along line II—II of FIG. 6.

A groove body 60 is in the machine body 50, see FIGS. 6 and 7. A rotary disk 70 is installed in the groove body 60. A bottom of the groove body 60 has an outlet 61 for outputting a merchandise 80. An inner diameter of the outlet 61 is slightly larger than an outer diameter of the merchandise 80. A lower side of the outlet 61 is connected to a transfer tube 51 to an opening 52 at a bottom of the machine body 50.

A rotary disk 70, referring to FIGS. 6, 7, has a plurality of receiving holes 71 for receiving the merchandises 71. An upper center of the rotary disk 70 has three helical rotatable rods 72. A bottom of the rotary disk 70 is installed with a plurality of rollers 73. The rotary disk 70 is rotatable in the groove body 60 by the driving of a motor 74.

Above structure of the present invention is similar to those used in the prior art, and thus, the details will not be described here. However, the features of the present invention will discuss in the following.

With reference to FIG. 5, the present invention further comprises the following elements.

A guide plate 90 is installed above the rotary disk 70. As shown in FIGS. 6, 7, the guide plate 90 is an approximate right-angled triangular plate. The guide plate 90 is obliquely installed above the rotary disk 70 corresponding to the upper side of the outlet 61 at the bottom of the groove body 60. A first right angle side 94 of the guide plate 90 is obliquely installed to a first wall of the groove body 60. A first apex 93 between the first right angle side 94 and the hypotenuse 92 is placed near an upper side of the rotary disk 70. The second right angle side 94 is horizontally installed to a second wall of the groove body 60 adjacent to the first wall of the groove body 60. A second apex 95 between the second right angle side 91 and the hypotenuse 92 is placed higher than the first apex 93. Furthermore, the hypotenuse 92 of the guide plate 90 is formed as a concave cambered edge.

Figure 8:
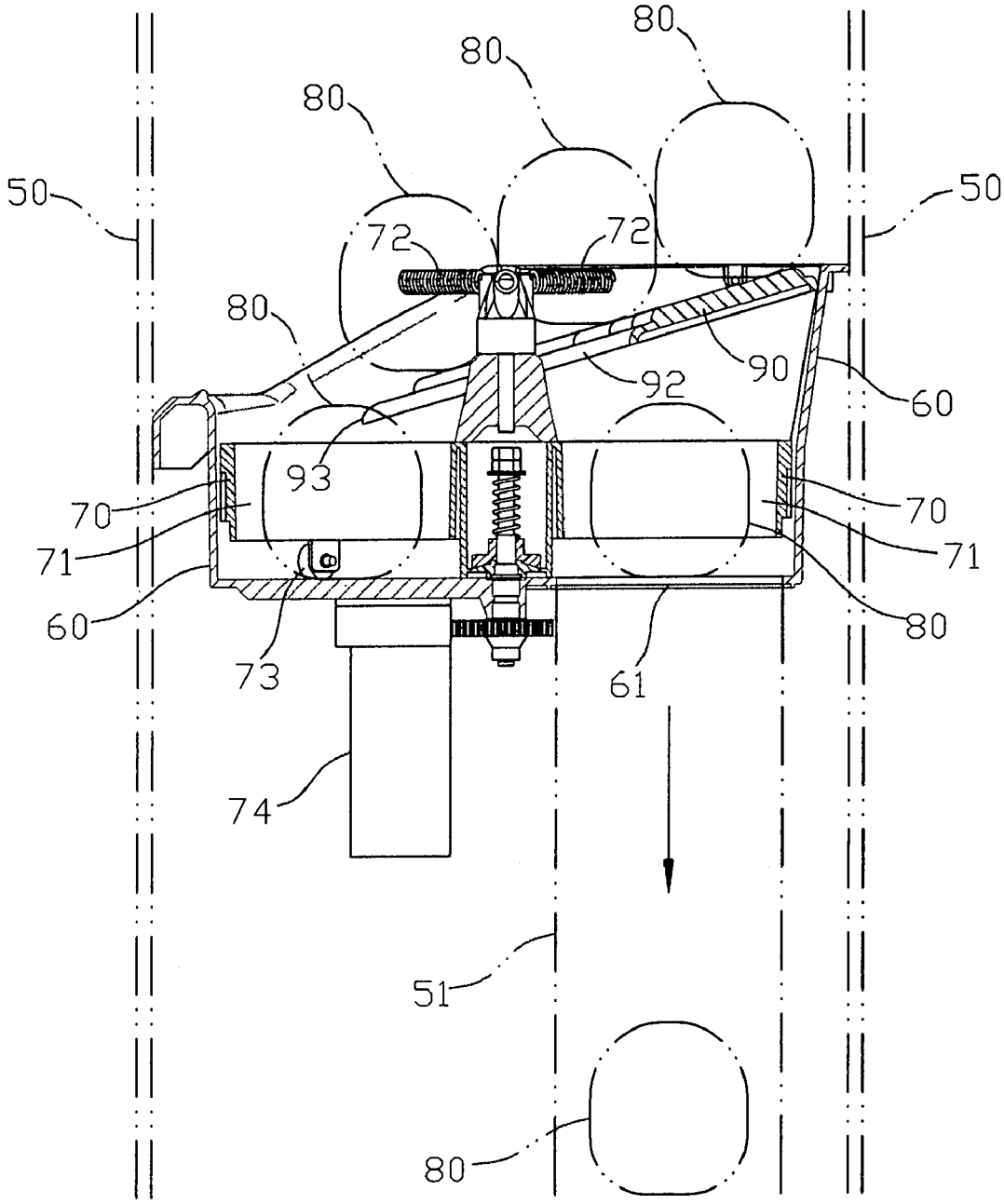
FIG. 8 shows the operation of the present invention.

With reference to FIG. 8, the present invention can be used to a prior art outlet of a vending machine. By the rotation of the rotary disk 70, the merchandises 80 in the receiving holes 71 of the rotary disk 70 are driven to be above the outlet 61 at the bottom of the groove body 60. Then the merchandises drop down from the outlet 61 to transfer along the transfer tube 51 to the opening 52 at the bottom of the machine body 50.

The guide plate 90 of the present invention has the following advantages.

Since the guide plate 90 is obliquely installed above the rotary disk 70 corresponding to the upper side of the outlet 61, the guide plate 90 pushes the merchandises 80 on the receiving holes 71 of the rotary disk 70 so that one merchandise can successfully drop in the receiving hole 71 of the tube body 51 to be outputted easily.

Since the guide plate 90 is obliquely installed above the rotary disk 70, and corresponding to the upper side of the outlet 61, overlapped merchandises on the rotary disk 70 can be pushed by the guide plate 90 so that the overlapped merchandises can be pushed upwards and then are separated. Thus, no merchandise is outputted repeatedly.

Further, since the guide plate 90 is obliquely installed above the rotary disk 70, the guide plate 90 can isolate some merchandises 80 from the rotary disk 70 so that the burden of the rotary disk 70 is reduced and thus the burden of the motor 74 is reduced. Thus, the rotary disk 70 rotates easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A merchandise output device of a vending machine comprising:

a machine body;

a groove body in the machine body; a bottom of the groove body having an outlet for outputting a merchandise; a lower side of the outlet being connected to a transfer tube to an opening at a bottom of the machine body;

a rotary disk installed in the groove body and having a plurality of receiving holes for receiving the merchandises; the rotary disk being rotatable in the groove body by the driving of a motor;

a guide plate installed above the rotary disk and the guide plate being an integral structure, the guide plate being an approximate right-angled triangular plate; the guide plate being obliquely installed above the rotary disk corresponding to the upper side of the outlet at the bottom of the groove body; a first side of the guide plate being obliquely installed to a first wall of the groove body, wherein the first side being a side adjacent to a right angle of the right-angled triangular plate; a first apex between the first side and the hypotenuse being placed near an upper side of the rotary disk; a second side being horizontally installed to a second wall of the groove body adjacent to the first wall of the groove body, wherein the second side being another side adjacent to the right angle of the right-angled triangular plate; a second apex between the second side and the hypotenuse being placed higher than the first apex;

wherein the hypotenuse of the guide plate is formed as a concave cambered edge; and wherein a plurality of ribs are formed on an upper side of the guide plate.

* * * * *